US008293377B2

(12) United States Patent
Nishiyama et al.

(10) Patent No.: US 8,293,377 B2
(45) Date of Patent: Oct. 23, 2012

(54) CASE FOR ROLLING POWDER ALLOY

(75) Inventors: Toshimasa Nishiyama, Tokyo (JP); Hideki Hommo, Niigata (JP); Tsutomu Komata, Niigata (JP)

(73) Assignee: Nikkeikin Aluminum Core Technology Company Ltd., Tokyo (JP)

( * ) Notice: Subject to any disclaimer, the term of this patent is extended or adjusted under 35 U.S.C. 154(b) by 428 days.

(21) Appl. No.: 12/532,011

(22) PCT Filed: Mar. 11, 2008

(86) PCT No.: PCT/JP2008/054397

§ 371 (c)(1),
(2), (4) Date: Sep. 18, 2009

(87) PCT Pub. No.: WO2008/114652

PCT Pub. Date: Sep. 25, 2008

(65) Prior Publication Data

US 2010/0086628 A1 Apr. 8, 2010

(30) Foreign Application Priority Data

Mar. 19, 2007 (JP) ..... 2007-070735

(51) Int. Cl.

| | |
|---|---|
| ***B22F 3/00*** | (2006.01) |
| ***B22F 7/08*** | (2006.01) |
| ***B22F 7/04*** | (2006.01) |
| ***B32B 1/08*** | (2006.01) |
| ***B32B 15/16*** | (2006.01) |

(52) U.S. Cl. ..... 428/558; 428/34.1; 419/8; 419/9; 419/43; 206/524.1; 220/682; 220/685

(58) Field of Classification Search ..... None
See application file for complete search history.

(56) References Cited

U.S. PATENT DOCUMENTS

| | | | | |
|---|---|---|---|---|
| 3,007,603 | A * | 11/1961 | Krehl | 220/618 |
| 3,290,853 | A * | 12/1966 | Pucci et al. | 52/836 |
| 3,340,053 | A * | 9/1967 | Hodge et al. | 419/8 |
| 3,611,546 | A * | 10/1971 | Haller | 419/26 |

(Continued)

FOREIGN PATENT DOCUMENTS

| | | |
|---|---|---|
| JP | S 49-96338 | 8/1974 |

(Continued)

*Primary Examiner* — John J Zimmerman
(74) *Attorney, Agent, or Firm* — Squire Sanders (US) LLP

(57) ABSTRACT

An object of this invention is to provide a case for rolling powder alloy without failures at the time of rolling. The case for rolling powder alloy (1) is formed like a shape of box and comprises a side constituent member (10) forming like a rectangular frame in a combination of two members (10*a*, 10*a*) and surrounding a side surface of metal powder, an upper lid constituent member (11) mounting on one opening of the side constituent member (10) and covering an upper surface of the metal powder, and a lower lid constituent member (12) mounting on the other opening of the side constituent member (10) and covering a lower surface of the metal powder. The peripheral edges of the upper lid constituent member (11) and the lower lid constituent member (12) are, respectively, provided with a peripheral wall (11*b*, 12*b*) standing upright along an outer peripheral surface of the side constituent member, and the side constituent member (10) is inserted into a space surrounded by the peripheral wall (11*b*, 12*b*). According to such case for rolling powder alloy, the aluminum powder alloy can be easily manufactured without failures at the time of rolling.

3 Claims, 5 Drawing Sheets

U.S. PATENT DOCUMENTS

| | | | | |
|---|---|---|---|---|
| 3,866,303 | A * | 2/1975 | Chehi | 419/48 |
| 4,935,198 | A * | 6/1990 | Tornberg | 419/8 |
| 4,980,126 | A * | 12/1990 | Juhas | 419/49 |
| 5,794,814 | A * | 8/1998 | Baerenwald | 220/685 |
| 5,887,741 | A * | 3/1999 | Chiang | 220/4.31 |
| 7,854,886 | B2 * | 12/2010 | Tamaki et al. | 419/8 |
| 7,854,887 | B2 * | 12/2010 | Nishiyama et al. | 419/8 |
| 7,878,324 | B2 * | 2/2011 | Bellamah et al. | 206/236 |
| 7,998,401 | B2 * | 8/2011 | Okaniwa et al. | 419/8 |
| 2004/0141866 | A1 * | 7/2004 | Forsberg et al. | 419/8 |
| 2009/0004499 | A1 * | 1/2009 | Vatchiants | 428/550 |
| 2009/0104470 | A1 * | 4/2009 | Suzuki et al. | 428/570 |
| 2009/0214886 | A1 * | 8/2009 | Ishii et al. | 428/556 |
| 2009/0220814 | A1 * | 9/2009 | Nishiyama et al. | 428/554 |
| 2010/0119401 | A1 * | 5/2010 | Nishiyama et al. | 419/28 |

FOREIGN PATENT DOCUMENTS

| | | | |
|---|---|---|---|
| JP | 6-93354 | * | 4/1994 |
| WO | 2006/070879 | A1 | 7/2006 |

* cited by examiner

CASE FOR ROLLING POWDER ALLOY

TECHNICAL FIELD

The present invention relates to a case for rolling powder alloy, which is used in a case where it manufactures aluminum powder alloy by powder metallurgy method.

BACKGROUND ART

In comparison with metallic melted alloy to manufacture by casting, the aluminum powder alloy has an advantage that it is constituted to be fine, add a lot of other elements, and distribute evenly reinforcement materials. Therefore, by these days, the aluminum powder alloy is increasing in use in the field of not only automobiles, vehicles, and aircrafts, but also the other engineering works such as architecture and civil engineering.

Conventionally, the aluminum powder alloy is manufactured by forming a desired shape and processing by hot press deformation, in a state which is temporarily molded by a hydraulic cold press molding or hot press molding, the temporary molded powder alloy is molded in a vessel, or sintered under pressure as contained in cans and the like.

However, on containing a lot of reinforcement materials and the like in the aluminum powder alloy, the composite material becomes brittle. Then, it has a problem to make it into a desired shape based on the conventional processing method.

For this reason, these applicants have proposed and come to put into practice a method for manufacturing a rolling material, which has a workability of the plasticity by hot rolling after processing an electric-pressure sintering every metal vessel in a state of containing the metal powder in the metal vessel, as described in a pamphlet of International Laid-Open Publication No. 2006-070879.

In a method for manufacturing the rolling material, a shape of box may be used as a metal vessel 101 containing metal powder such that a rectangular frame member 110 is formed in a combination of four sheets of metal plates 111, 111, . . . by a method of we and the like and grasped by lid members 112, 112, . . . composed of rectangular metal plates on both upper and lower sides (left and right in FIG. 6B) of the frame member 110, as shown in FIGS. 6A and 6B. In this constitution, the metal vessel 101 is constituted to adhere respectively between the frame member and each of the members 112, 112 by an electric-pressure sintering.

As a conventional metal vessel 115, an upper member 113 and a lower member 114, which is formed in the rectangular metal plate as shown in FIGS. 6C and 6D, may be used in constitution to face one concave portions with the other each other. The upper member 113 and the lower member 114 are adhered in a state which adhesive members 113*a*, 114*a*, as formed at each of their peripheral edges, are piled by an electric-pressure sintering. In addition, a numeral 116 is a reinforcement material for rolling, which prevents from a concentration of rolling pressure in the metal vessel at the time of rolling.

However, in the conventional metal vessel 101 of the former, it has a problem that a bondability by means of an electric-pressure sintering between the frame member 110 and the lid member 112 may decrease and both members result in separating each other, in a case where the metal powder 102 intervenes between the frame member 110 and the lid member 112. In such a way, when the frame member 110 and the lid member 112 are separated, it is impossible to manufacture the aluminum powder alloy, as the rolling cannot be used.

In addition, the metal vessel 101 may be adhered by welding on the upper and lower sides thereof between the frame member 110 and the lid member 112 after processing the electric-pressure sintering, as an object for reinforcing the adhesion between the frame member 110 and the lid member 112. In this case, a weld bead is respectively formed on each of upper and lower sides of the metal vessel 101. Then, it is required to scrape out the we bead in order to affect an even pressure for rolling in the metal vessel at the time of rolling. It has a problem that it takes much works to scrape out the we bead and the lid member 112 may be damaged.

It has a case where the metal powder 102 may intervene between the adhesive members 113*a*, 114*a* also in the metal vessel 115 of the latter. As a bondability by the electric-pressure sintering between the upper member 113 and the lower member 114 decreases, there has a fear for failures in the metal vessel 115.

DISCLOSURE OF THE INVENTION

Therefore, these inventors have engaged in the research and development to deal with the above conventional problems and come to create this invention. In other words, it is an aspect of the present invention to provide a case for rolling powder alloy, of which failures do not occur at the time of rolling.

More specifically, the case for rolling powder alloy, as formed like a shape of box, comprises a side constituent member forming like a rectangular frame in a combination of a plurality of members and surrounding a side surface of the metal powder, an upper lid constituent member mounting on one opening of the side constituent member and covering an upper surface of the metal powder, and a lower lid constituent member mounting on the other opening of the side constituent member and covering a lower surface of the metal powder. The case for rolling powder alloy, as formed like a shape of box, comprises a side constituent member surrounding the side surface of metal powder, the upper lid constituent member covering an upper surface of the metal powder, and the lower lid constituent member covering a lower surface of the metal powder. The case is characterized in that at least one peripheral edge of the upper lid constituent member and the lower lid constituent member is provided with a peripheral wall standing upright along an outer peripheral surface of the side constituent member, and the side constituent member is inserted into a space surrounded by the peripheral wall.

According to the case for rolling powder alloy, as at least one of the upper lid constituent member and the lower lid constituent member is fitted with the side constituent member by inserting the side constituent member into a space surrounded by the peripheral wall, the adhesion between the side constituent member and each of the upper lid constituent member and the lower lid constituent member is performed by an outer peripheral surface of the side constituent member and an inner peripheral surface of the peripheral wall. Therefore, the adhesion never becomes incomplete by the intervention of the metal powder.

In the manufacture of rolling material, the metal powder may be sintered in a state as contained in the case for rolling powder alloy. Though each of constituent members (side constituent member, upper lid constituent member, and lower lid constituent member), which constitute the case for rolling powder alloy, is mutually adhered by sintering under pressure, when the metal powder is intervened in the adhesive surface of the constituent members, clearances may occur in the adhesive surface, and it becomes hard to be adhered each other. On the other hand, the case for rolling powder alloy relating to the present invention is constituted to adhere between the side constituent member and each of the upper lid constituent member and the lower lid constituent member by close contacts among sides (outer peripheral surface of the side constituent member and inner peripheral surface of the peripheral wall) as the metal powder being hard to attach. Thus, it is possible to keep the desired bondability therein without the intervention of the metal powder.

According to the above case for rolling powder alloy, as the adhesion between the side constituent member and each of the upper lid constituent member and the lower lid constituent member is performed in the outer per surface of the side constituent member, the reinforcement of the adhesion of the constituent members may be performed to weld in the sides of the case for rolling powder alloy in case of welding thereof. Accordingly, as a flatness of the upper and lower surfaces of the case for rolling powder alloy can be maintained, it is not required to scrape out the weld beads, then to omit some works.

In the constitution of the case for rolling powder alloy, the per edges of the upper lid constituent member and the lower lid constituent member are respectively provided with the peripheral wall standing upright along the outer peripheral surface of the side constituent member, and the outer peripheral surface of the side constituent member is provided with a projected portion placed in a center in a direction of the height thereof along a peripheral direction. Also, in the constitution of the case for rolling powder alloy, an upper portion over the projected portion of the side constituent member may be inserted into a space surrounded by the per wall formed in the per edge of the upper lid constituent member, and a lower portion below the projected portion of the side constituent member may be inserted into a space surrounded by the per edge formed in the per edge of the lower lid constituent member.

According to the case for rolling powder alloy, the adhesion between the side constituent member and each of the upper lid constituent member and the lower lid constituent member is performed between the upper and lower surfaces of the projected portion and the top portion of the peripheral wall, together with between the outer peripheral surface of the side constituent member and the inner peripheral surface of the peripheral wall. Thus, it prevents from incomplete adhesion thereof.

Furthermore, in the case for rolling powder alloy, the projected portion is provided with an auxiliary slip formed integrally with a top portion and formed like around Letter 'T' in cross section. Then, an outer per surface of the peripheral wall may be surrounded by the auxiliary slip.

According to the case for rolling powder alloy, it is desirable that the peripheral wall is surrounded by the auxiliary slip and the adhesion between the side constituent member and each of the upper lid constituent member and the lower lid constituent member is strongly performed.

Various aspects and effects of the above-mentioned present invention as well as the other effects and further features thereof will be more clear and apparent in accordance with the below-mentioned detailed description of the illustrative and non-restricted embodiments with reference to the attached drawings.

BRIEF DESCRIPTION OF THE DRAWINGS

FIG. 2A is a plane sectional view and FIG. 2B is a longitudinal sectional view.

BEST MODE FOR CARRYING OUT THE INVENTION

A preferred embodiment of the present invention will be described in detail with reference to the drawings. In the following description, the same numeral is used as the same element to omit a repetition of descriptions.

Figure 1:
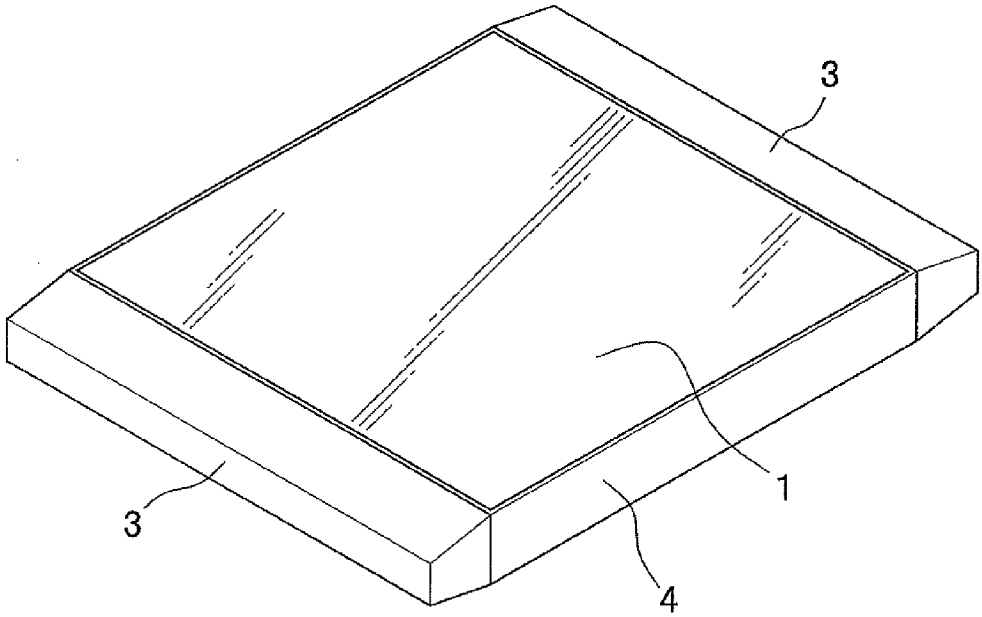
FIG. 1 is a perspective view showing a whole case for rolling powder alloy relating to a preferred embodiment of the present invention.

The case for rolling powder alloy 1 relating to this embodiment is formed to be a shape of box as shown in FIGS. 1 and 2. The case is manufactured by rolling after sintering under pressure in a state containing a set of the metal powder (hereinafter as referred to simply as metal powder). In the forward and rear surfaces (a surface crossing to a rolling direction) in a rolling direction of the case for rolling powder alloy 1, a reinforcement material for rolling 3 is integrally mounted thereon. The side of the case for rolling powder alloy 1 is covered with a metal foil 4.

Figure 2A:
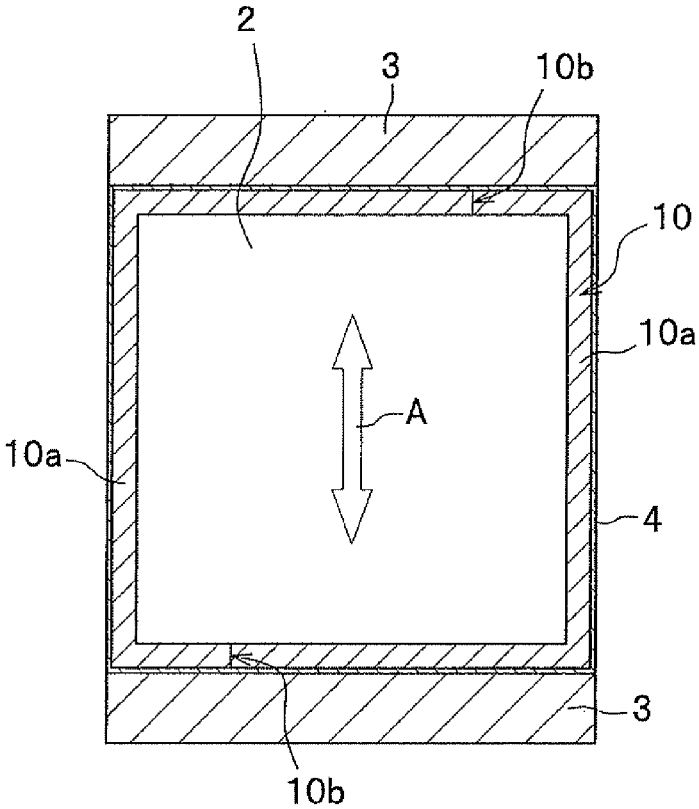
FIGS. 2A and 2B are views showing the case for rolling powder alloy relating to a preferred embodiment of the present invention.
Figure 2B:
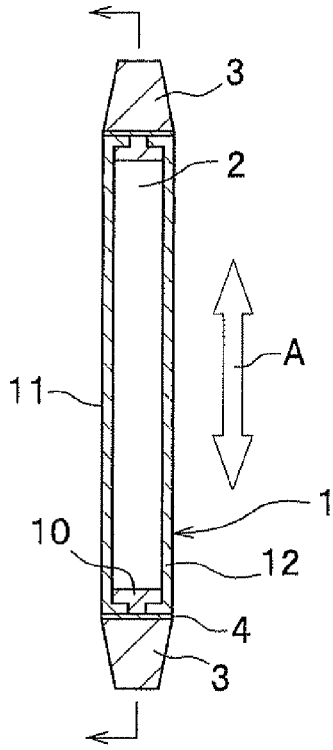

As shown in FIGS. 2A and 2B, the case for rolling powder alloy 1 is constituted by a side constituent member 10, as formed like a rectangular frame, covering a side of metal powder 2 as manufactured by compression, an upper lid constituent member 11, as mounted on one opening of the side constituent members 10, covering an upper surface of the metal powder 2, and a lower lid constituent member 12, as mounted on the other opening of the side constituent member 10, covering a lower surface of the metal powder 2. The material constituting the case for rolling powder alloy 1 is not limited to the above material even in case of metallic materials. For example, the material such as aluminum and stainless can be used.

As shown in FIGS. 2A and 2B, the side constituent member 10 is constituted like a rectangular pipe (or a rectangular frame), as seen on a plane, by putting two members 10*a*, 10*a* together, which forms a space for containing the metal powder 2 therein.

As shown in FIG. 2A, adhesive portions 10*b*, 10*b* between members 10*a*, 10*a* constituting the side constituent member 10 is mounted on a pair of sides as opposed each other. The adhesive portions 10*b*, 10*b* are arranged at a position to be shifted from a central portion in a direction of the width of this plane (a left-to-right direction in FIG. 2A).

In this embodiment, an adhesive portion 10*b* formed in one side (upper side in FIG. 2A) is arranged to be slightly shifted in a right direction, and an adhesive portion 10*b* formed in the other side (lower side in FIG. 2A) is arranged to be slightly shifted in a left direction. Thus, each of the adhesive portions 10*b*, 10*b* is respectively arranged at a position to be shifted by the same distance from the central portion of the side. That is, both members 10*a*, 10*a* are formed in the same shape.

Though the side constituent member 10 is constituted by two members 10*a*, 10*a* in this embodiment, a number for separating the side constituent member 10 is not limited to the above number, but it may be an appropriate number. The above two members 10*a*, 10*a* are not necessarily required to form the same shape. It goes without saying that a direction to shift from a center of the side is not limited. Further, a thing to be integrally constituted may be used as the side constituent member 10.

Figure 3:
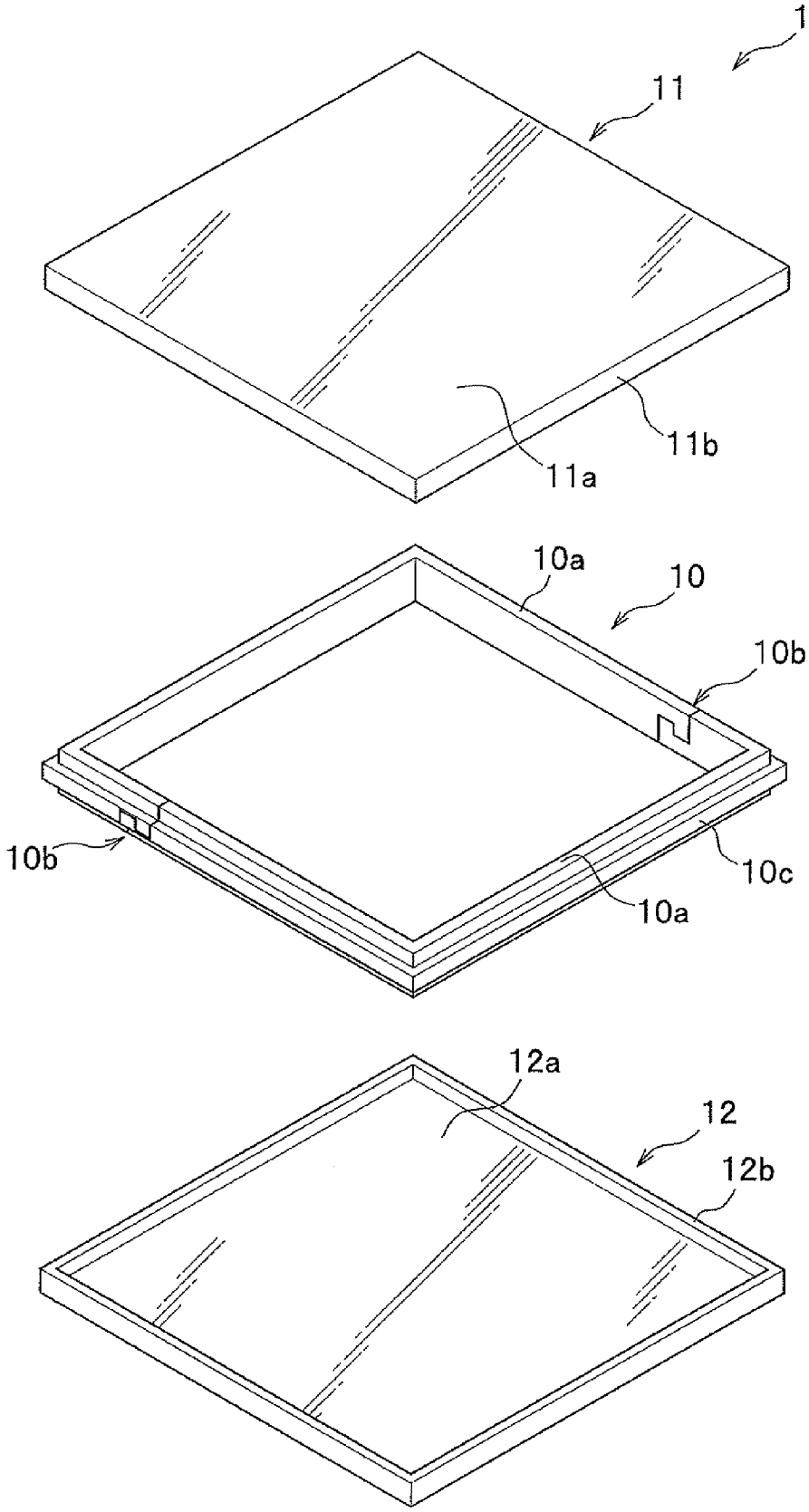
FIG. 3 is an exploded perspective view showing the case for rolling powder alloy relating to a preferred embodiment of the present invention.
Figure 5A:
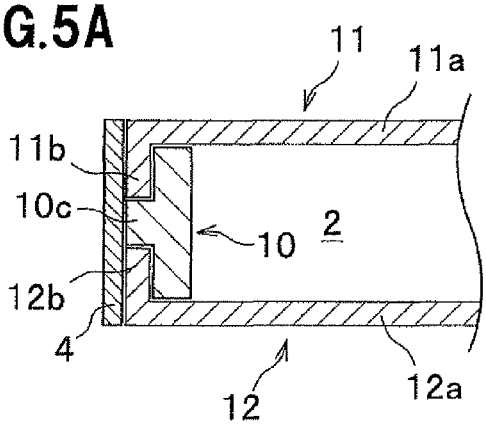
FIGS. 5A to 5H are partial sectional views showing the adhesive portions between the side constituent member and each of the upper lid member and the lower lid member of the case for rolling powder alloy relating to a preferred embodiment of the present invention.

As shown in FIG. 3 and FIG. 5A, a projected portion 10*c* is formed at a central position in a direction of the height along an outer peripheral direction. The projected portion 10*c* is constituted to project from the side constituent member 10 to be the same height (thickness) as the thickness of the peripheral walls 11*b*, 12*b* of the later-described upper lid constituent member 11 and lower lid constituent member 12. Further, an upper portion of the projected portion 10*c* of the side constituent portion 10 is inserted into a space as formed by the peripheral wall 11*b* of the upper lid constituent portion 11, and a lower portion of the projected portion 10*c* is inserted into a space as formed by the peripheral wall 12*b* of the lower lid constituent member 12. Then, the side constituent member 10 is fitted with the upper lid constituent member 11 and the lower lid constituent member 12, respectively.

Figure 4A:
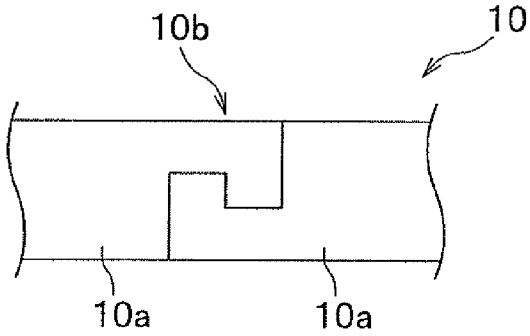
FIGS. 4A to 4D are side views showing adhesive portions of the side constituent member of the case for rolling powder alloy relating to a preferred embodiment of the present invention.

As shown in FIG. 3 and FIG. 4A, an end portion (portion corresponding to the adhesive portion 10*b*) of the members 10*a*, 10*a* constituting the side constituent member 10 is formed like a hooked shape so as to fit with each other in the adhesive portion 10*b*. Thus, as the side constituent member 10 is mutually fitted with by a pair of the members 10*a*, 10*a* at the adhesive portion 10*b*, cracks or sieve openings caused by a stress at the time of rolling can be prevented in the adhesive portion 10*b*.

As shown in FIG. 3, the upper lid constituent member 11 comprises a rectangular lid main body 11*a* formed depending on an outer peripheral shape of the side constituent member 10, and a peripheral wall 11*b* standing upright in a peripheral edge of the lid main body 11*a*.

As shown in FIG. 5A, the upper lid constituent member 11 is constituted to fit with the side constituent member 10 such that the per wall 11*b* is disposed to cover an outer peripheral surface placed at an upper portion over the projected portion 10*c* of the side constituent member 10.

In this embodiment, the upper lid constituent member 11 is constituted to form a peripheral wall 11*b* by deep drawing processing in a peripheral edge of the lid main body 11*a* as being a rectangular metal plate. In addition, a method for forming the upper lid constituent member 11 is not limited to the above method. It may be formed by selecting an appropriate method such as a method for bending at the peripheral edge of the lid main body 11*a* and a method for extrusion molding.

As shown in FIG. 3, the lower lid constituent member 12 is constituted to comprise a rectangular lid main body 12*a* forming depending on an outer peripheral shape of the side constituent member 10, and a peripheral wall 12*b* standing upright at the peripheral edge of the lid main body 12*a*.

As shown in FIG. 5A, the lower lid constituent member 12 is fitted with the side constituent member 10 by disposing to cover the outer peripheral surface by the peripheral wall 12*b* in the lower portion below the projected portion 10*c* of the side constituent member 10.

In addition, a method for forming the lower lid constituent member 12 is performed by the same method for forming the upper lid constituent member 11.

In this way, the case for rolling powder alloy 1 is constituted by fitting the side constituent member 10 with the upper lid constituent member 11 and the lower lid constituent member 12, respectively.

As shown in FIG. 1, the reinforcement material for rolling 3 is a material mounted on the forward and rear sides of the case for rolling powder alloy 1 to be formed like a taper or a trapezoid in section. In this reinforcement material for rolling 3, the farther the top thereof proceeds, the thinner the thickness thereof becomes. The reinforcement material for rolling 3 formed to be thinner in thickness at the top thereof is easy to relieve the rolling load at the time of rolling into the side constituent member 10. In this embodiment, though the reinforcement material for rolling 3 is designed to mount on a surface crossing to a rolling direction of the case for rolling powder alloy 1, it is not limited to this constitution, but may be disposed to cover the outer per surface of the case for rolling powder alloy 1. It goes without saying that the reinforcement material for rolling 3 may be omitted. In this embodiment, as shown in FIG. 2B, though a thickness (height) in the side of the case for rolling powder alloy 1 of the reinforcement material for rolling 3 is constituted to be the same thickness (height) of the case for rolling powder alloy, the pressure in the case for rolling powder alloy 1 may be urged in the beginning by making a thickness of the reinforcement material for rolling 3 to be slightly thicker.

As shown in FIG. 1, the metal foil 4 is designed to cover the outer side of the case for rolling powder alloy 1 to conceal the adhesive portions at the side between the side constituent member 10 and each of the upper lid constituent member 11 and the lower lid constituent member 12. Then, a groove (line) of the adhesive portion does not appear in the side of finished goods (aluminum powder alloy). In addition, the metal foil 4 may be mounted, depending on its necessity. It is not necessarily required to mount it.

A method for manufacturing the rolling material relating to this embodiment is performed by a containing step of the metal powder 2 in the case for rolling powder alloy 1, a mounting step of the metal foil for covering the metal foil 4 on the side of the case for rolling powder alloy 1 containing the metal powder 2, and a sintering step for manufacturing the clad material by sintering the case for rolling powder alloy 1 covered with the metal foil 4, and a rolling step of the clad material.

The containing step covers upper and lower surfaces of the metal powder 2 by the upper lid constituent member 11 and the lower lid constituent member 12 in a state that the metal powder 2 is contained in an inside space of the side constituent member 10 constituted by a combination of the members 10*a*, 10*a*. At this time, the metal powder 2 is in close contact with the case for rolling powder alloy 1. The side constituent member 10 is fitted with the upper lid constituent member 11 and the lower lid constituent member 12 in a state that an outer surface at the upper portion over the projected portion 10*c* of the side constituent member 10 and an outer surface at the lower portion below the projected portion 10*c* of the side constituent portion 10 are, respectively, in a close contact with the peripheral wall 11*b* of the upper constituent member 11 and the peripheral wall 12*b* of the lower lid constituent member 12. In this embodiment, provisional powder manufacture, which is formed to pre-solidify the mixed powder between aluminum and ceramics in the prescribed shape, is used as the metal powder 2. The metal powder (provisional powder manufacture) is, for example, formed to be an apparent density 1.65 by the press of 100 tonage and to be small in density. It is solidified to such a degree that it is easily collapsed by handling, etc.

The case for rolling powder alloy 1 may be designed to assemble the side constituent member 10, the upper lid constituent member 11, and the lower lid constituent member 12, after the metal powder 2 is pre-arranged at the prescribed position to cover the surroundings of the metal powder 2, or may be designed to fill up the metal alloy 2 inside the side constituent member 10 as pre-fabricated. An order of the assembling is not particularly limited to the above.

In addition, a method for forming the metal powder 2 (provisional powder manufacture) or the like is not limited, and may be performed by an appropriate well-known method. The material constituting the metal powder 2 is not limited to the above, but for example, the material as constituted by only aluminum may be used. It can be appropriately selected, depending on various situations such as the use of the aluminum powder alloy after its completion. The metal powder 2 is not used as the provisional powder manufacture, but may be used to fill directly in the case for rolling powder alloy 1 in a state of powder.

In the mounting step of the metal foil, it is constituted to expose the adhesive portions between the side constituent member 10 and each of the upper lid constituent member 11 and the lower lid constituent member 12 by covering an outer side of the case for rolling powder alloy 1 containing the metal powder 2 with the metal foil 4.

The sintering step is a step for manufacturing the clad material performing the electric-pressure sintering of the case for rolling powder alloy 1 containing the metal powder 2. The electric-pressure sintering may be performed by a we method. For example, after it is filled with an inert atmosphere gas in a vacuum vessel, depending on its necessity, in a reduced-pressure state that the vacuum vessel is sealed up and the air in a sintering furnace is sucked by a vacuum pump and the like, an upper punching member and a lower punching member actuate. Then, after the material inside a mold die is compressed at the prescribed pressure, the material is sintered under pressure by energizing the direct-current pulse current through the upper and lower punching members in the obtained high-density compressive body. The condition of the electric-pressure sintering is designated at an electric current 5000 to 30000 Amp., an temperature rising rate: 10 to 300° C./min., sintering temperature: 500 to 650° C., retention time: 5 min. or more, and pressure: 5 to 10 MPa under a vacuum ambience equal to or less than 0.1 torr of vacuum.

In addition, the welding step for adhering between the side constituent member 10 and each of the upper lid constituent member 11 and the lower lid constituent member 12 may be provided, depending on its necessity, after the sintering step and before the rolling step.

In the welding step, the projected portion 10*c* of the side constituent member 10 and the peripheral wall 11*b* of the upper lid constituent member 11, and the projected portion 10*c* of the side constituent member 10 and the per wall 12*b* of the lower lid constituent member 12 are, respectively, adhered in the side of the clad material. In the case for rolling powder alloy 1 relating to this embodiment, a weld adhesion between the side constituent member 10 and each of the upper lid constituent member 11 and the lower lid constituent member 12 are, respectively, performed at the side surface of the clad material. Thus, the weld bead is not formed on the upper and lower sides of the clad members, and also is not malaffected by rolling. That is, the ruggedness or concave and convex portion is formed on an upper and lower sides of the clad material owing to the weld bead. Then, it has no problems that the pressure for rolling is not affected evenly by the pressure for rolling. As a work for scraping off the we bead is not required, it is possible to cut down a step for the work in the welding step and to obtain a cost down.

The rolling step is a step for generating (manufacturing the rolling material) the aluminum powder alloy by stretching under pressure on the upper and lower sides, after the reinforcement material for rolling 3 is mounted on the clad material as performed by the electric-pressure sintering in the sintering step. The rolling of the clad material is performed in a direction crossing at aright angle to a surface facing the adhesive portion 10*b* (direction A). After an enough amount of rolling is performed to a rolling direction A, the clad material is rotated to roll in the other direction, depending on its necessity. In addition, the reinforcement material for rolling 3, together with the case for rolling powder alloy 1, may be performed by the electric-pressure sintering in the sintering step.

As above mentioned, according to the case for rolling powder alloy relating to this embodiment, as the adhesions between the side constituent member 10 and each of the upper lid constituent member 11 and the lower lid constituent member 12 are, respectively, performed by disposing the peripheral walls 11*b*, 12*b* along the outer peripheral surface of the side constituent member 10, failures do not occur at the time of rolling. Further, as the sintering under pressure is performed, the case for rolling powder alloy is integrally constituted to have a higher quality of aluminum powder alloy.

The side constituent member 10 and each of the upper lid constituent member 11 and the lower lid constituent member 12 are, respectively, adhered by sintering under pressure in a state that outer peripheral surfaces of the upper portion over and the lower portion below the projected portion 10*c* are, respectively, in close contact with inner surfaces of the peripheral wall 11*b*, 12*b*. Thus, the adhesions between the side constituent member 10 and each of the upper lid constituent member 11 or the lower lid constituent member 12 do not become imperfect, even if the metal powder intervenes between the upper surface or the lower surface of the side constituent member 10 and the lower surface of the upper lid constituent member 11 or the upper surface of the lower lid constituent member 12.

As the adhesive portion 10*b* between the members 10*a*, 10*a* is not disposed at the corners of the case for rolling powder alloy receiving a large force at the time of rolling, any failure does not occur in the case for rolling powder alloy 1. Thus, it is desirable.

As the adhesion between the members 10*a*, 10*a* is constituted to fit each other, it is integrally constituted by sintering under pressure. Thus, there has no cracks or sieve openings at the time of rolling. As the adhesive portion 10*b* is disposed at a position shifting from a center of the surface crossing to a rolling direction A acting the tensile stress on most greatly, failures can be prevented.

As the side of the case for rolling powder alloy 1 is covered with the metal foil 4, the adhesive portions between the side constituent member 10 and each of the upper lid constituent member 11 and the lower lid constituent member 12 do not expose to the outside. Therefore, a degree of freedom of the use of the manufactured aluminum powder alloy (rolling material) increases.

As the reinforcement material for rolling 3 is fixed at the time of rolling, it is possible to perform the rolling effectively, and there occurs no damages by reinforcement of the case for rolling powder alloy (clad material) 1.

As above mentioned, though the present invention is described with respect to the preferred embodiments, it is not limited to each of the above embodiments. The present invention may be appropriately modified within a scope thereof without departing from the spirit and gist thereof.

For example, though the above embodiment is constituted to perform an electric-pressure sintering in the case for rolling powder alloy 1 containing the metal powder 2 in the sintering step before rolling, the case for rolling powder alloy 1 containing the metal powder 2 can be designed to perform the rolling without the sintering step.

Though the above embodiment is, as shown in FIG. 5A, constituted to form the projected portion 10*c* on the outer peripheral surface of the side constituent member 10, a shape of the side constituent member is not limited thereto. In other words, as shown in FIG. 5B, the outer peripheral surface of the side constituent member 10 may be a plane, which has no projected portion 10*c* (as referred to FIG. 5A). In this case, the upper lid constituent member 11 and the lower lid constituent member 12 may be disposed along the outer peripheral surface of the side constituent member 10. In addition, as shown in FIG. 5C, it may be constituted to form the peripheral wall 11*b* only in either the upper lid constituent member 11 or the lower lid constituent member 12 and cover the outer peripheral surface of the side constituent member 10.

As shown in FIG. 5B, the adhesive portions between the side constituent member 10 and the side wall 11*b*, 12*b* may be designed to adhere aluminum tapes 13 and the like in seams. This conceals the seams and results in the prevention against cracks or sieve openings, and against falling out the metal powder from the seams at the time of rolling. As the seams are adhered by the aluminum tapes 13, the seams of the adhering portions between the side constituent member 10 and the side walls 11*b*, 12*b* are not exposed in the outside. In a case where the upper lid constituent member 11 and the lower lid constituent member 12 are directly adhered, as shown in FIG. 5C, the adhering portion between the upper lid constituent member 11 and the lower lid constituent member 12 may be constituted to adhere the aluminum tapes 13 and the like in the seams. In addition, it goes without saying that the aluminum tapes 13 may be used for the adhesion, depending on its necessity.

Figure 5E:
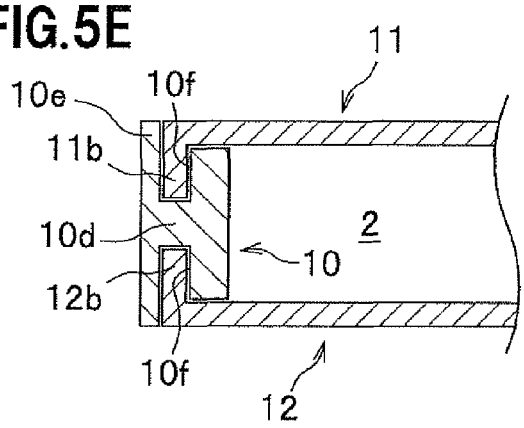
Figure 5B:
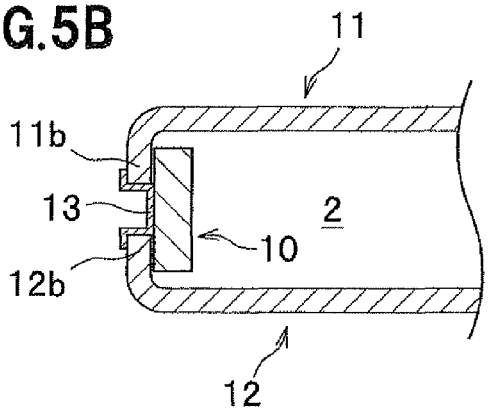
Figure 5F:
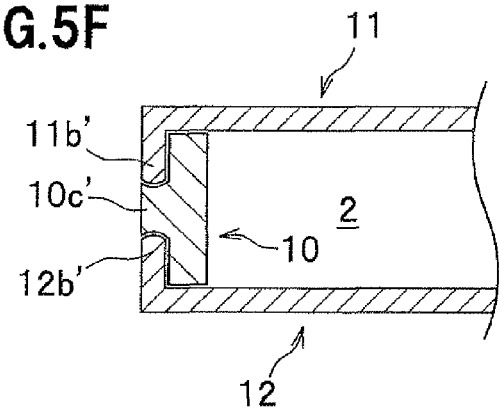
Figure 5C:
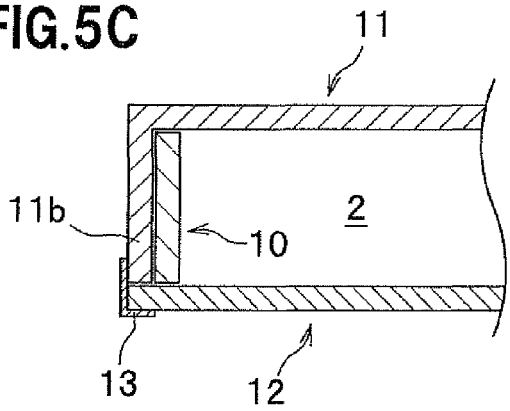
Figure 5G:
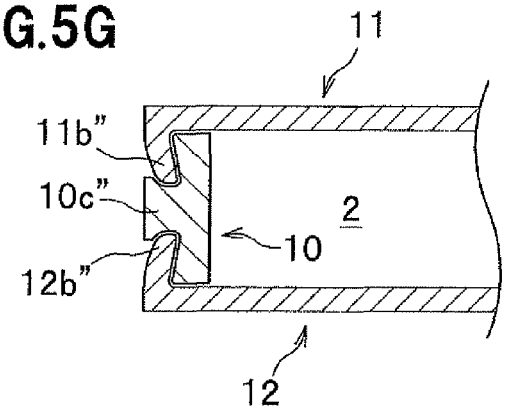
Figure 5D:
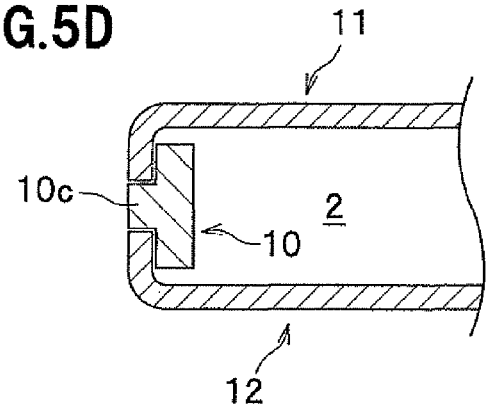

Though the above embodiments are constituted to cover the side of the case for rolling powder alloy 1 with the metal foil 4, the metal foil 4 may be, for example, omitted as shown in FIG. 5D, in a case where lines of the adhering portions between the side constituent member 10 and each of the upper lid constituent member 11 and the lower lid constituent member 12 are allowed to expose to the side of the finished goods.

As shown in FIG. 5E, the projected portion 10*d* as the side constituent member 10 may be provided with an auxiliary slip 10*e*, as integrally formed at the top thereof, to form like a shape of Letter 'T' in section. As this constitution, as the concave portions 10*f*, 10*f* inserting the peripheral wall 11*b*, 12*b* between the outer peripheral surface of the side constituent member 10 and the auxiliary slip 10*e* are formed, the per walls 11*b*, 12*b* can be inserted into the side constituent member 10. The inner surface of the auxiliary slip 10*e* is sintered under pressure in a state as being close contact with the outer per surface of the per walls 11*b*, 12*b*. Thus, the adhesions between the side constituent member 10 and each of the upper lid constituent member 11 and the lower lid constituent member 12 are strongly performed. Further, as the auxiliary slip 10*e* is constituted to cover the adhesive portions between the side constituent member 10 and each of the upper lid constituent member 11 and the lower lid constituent member 12, lines of the adhesive portions are not exposed to the side.

As shown in FIG. 5F, it may be constituted to form like a circular arc at the top portions of the peripheral walls 11*b*', 12*b*' of the upper lid constituent member 11 and the lower lid constituent member 12, to form like a circular arc at the portions corresponding to the per walls 11*b*', 12*b*' in the projected portion 10*c*' of the side constituent member 10, and to fit therebetween each other. As a result, the peripheral walls 11*b*', 12*b*' can be constituted to prevent from opening toward the outside.

Further, as shown in FIG. 5G, the peripheral walls 11*b*", 12*b*" of the upper lid constituent member 11 and the lower lid constituent member 12 may be constituted to slant toward an inside direction. Furthermore, it may be constituted to form a recess in the projected portion 10*c*" and fit with the top portions of the per walls 11*b*", 12*b*" therein. In this constitution, the peripheral walls 11*b*", 12*b*" can be prevented from opening toward the outside.

Figure 5H:
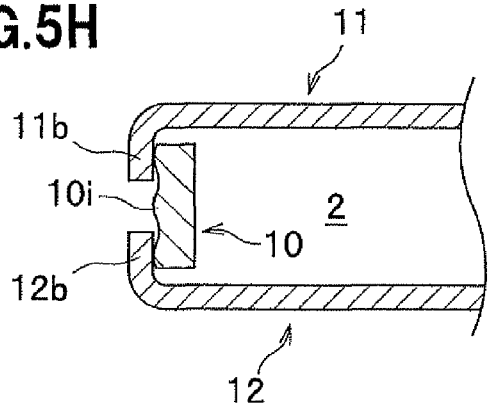
Figure 6A:
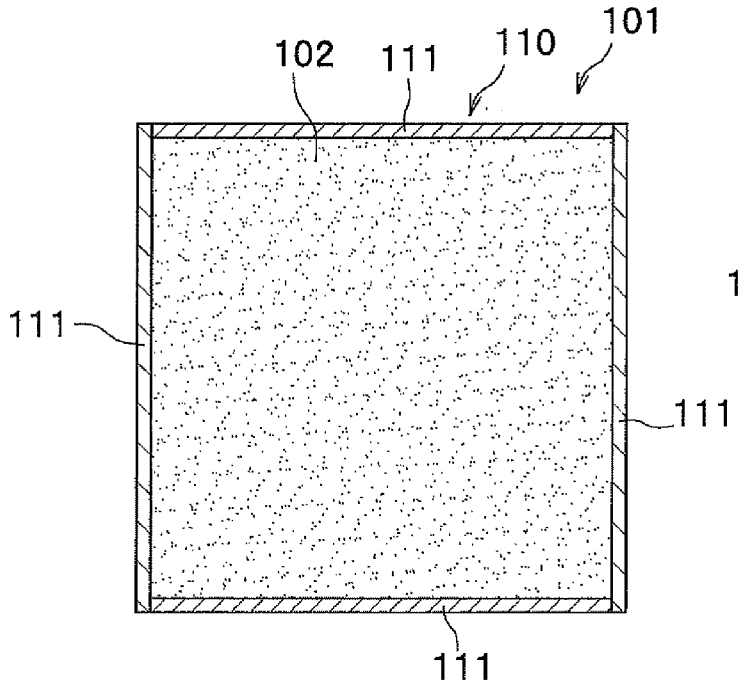
FIG.6A Prior Art
FIGS. 6A and 6C are plane sectional views showing a conventional case for rolling powder alloy.
Figure 6B:
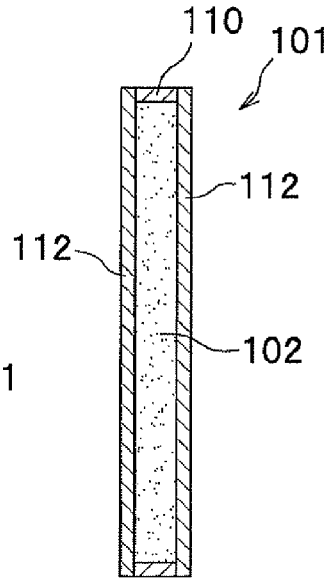
FIG.6B Prior Art
FIGS. 6B and 6D are longitudinal sectional views of the same.
Figure 6C:
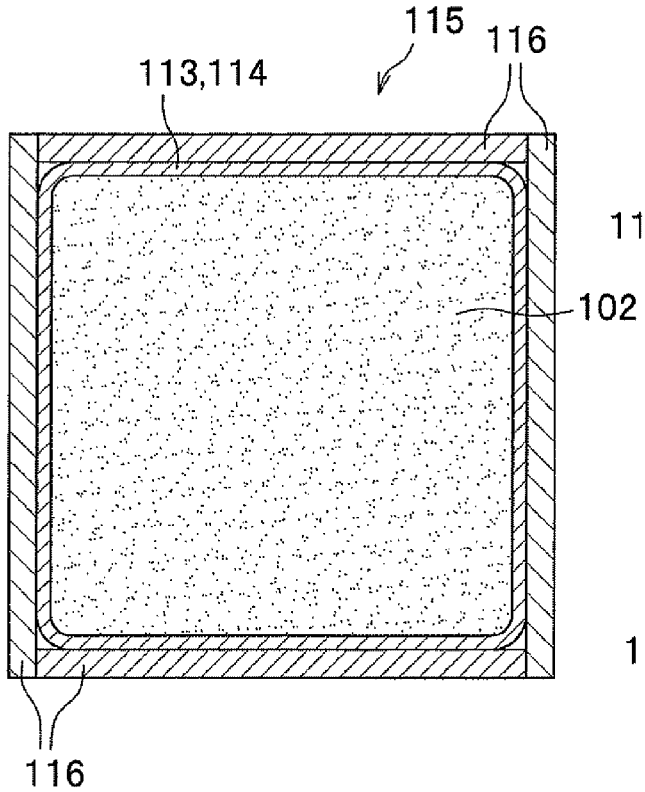
FIG.6C Prior Art
Figure 6D:
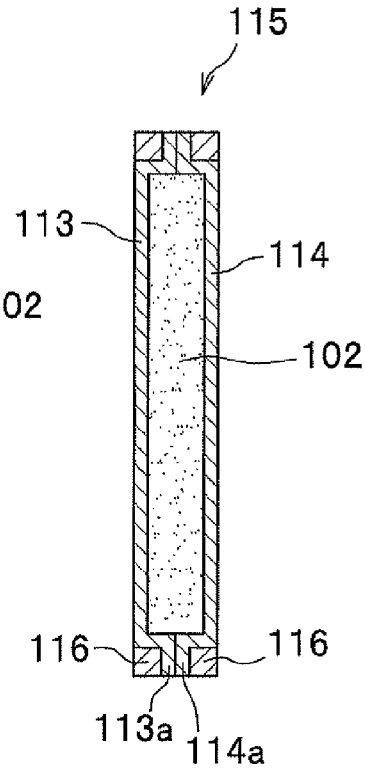
FIG.6D Prior Art

The side constituent member 10 may be, as shown in FIG. 5H, constituted to form a wavy ruggedness, or concave and convex surface 10*i* by cutting out the surface thereof and to be easily compressed at the time of rolling. In this way, it can prevent from bucking of the side constituent member 10 at the time of rolling and form the aluminum powder alloy in a desired shape by the provision of the ruggedness, or concave and convex surface 10*i* in the side constituent member 10. In addition, though a shape of the ruggedness, or concave and convex surface 10*i* is not limited to the above, but may be appropriately modified, it is desirable that a sectional area of the side constituent member 10 amounts to be around 80 percentages of a sectional area including a notch portion of the ruggedness, or concave and convex surface 10*i*. Though the notch is formed only in an outer surface of the side constituent member 10, the notch may be formed in the inner peripheral surface, or in both surfaces thereof.

Figure 4B:
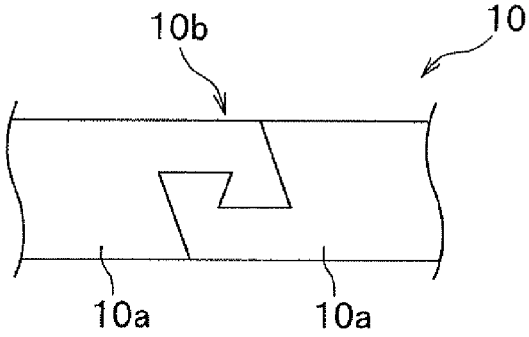
Figure 4C:
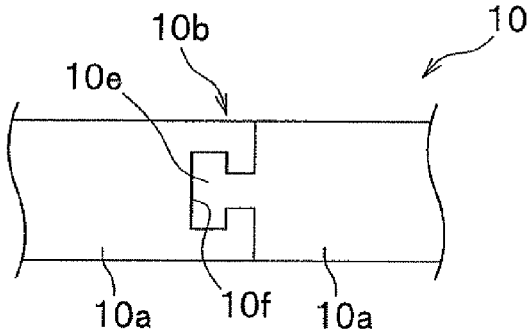

As shown in FIG. 4A, though the adhesive portion between members constituting the side constituent member is constituted to prevent from cracks or sieve opening in a transverse direction (left-and-right direction in FIG. 4A) therein by fitting a hooked portion like a shape of Letter 'L' formed at respective end portion, a shape of the hooked portion is not limited thereto. In other words, a shape of the hooked portion may be hard to space in either direction of both an upper and lower sides, as shown in FIG. 4B. As shown in FIG. 4C, it may be constituted such that a projected portion 10*e* like a shape of Letter 'T' is formed at an end portion of one member 10*a*, a groove 10*f* having the shape corresponding to the shape of the projected portion 10*e* is formed at an end portion of the other member 10*a*, and the both are fitted each other. In addition, as shown in FIG. 4C, though the projected portion 10*e* is formed like an approximately Letter 'T', a shape of the projected portion 10*e* is not limited to the above.

Figure 4D:
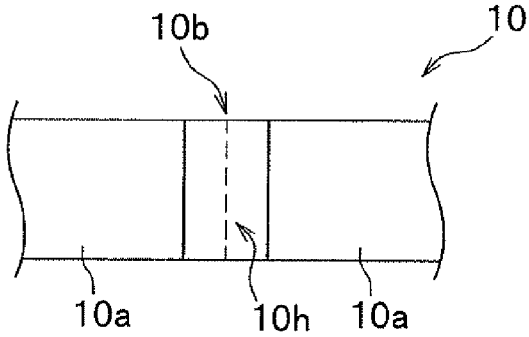
Figure 4E:
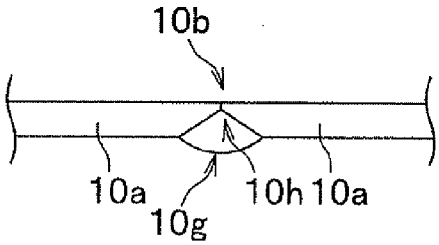
FIG. 4E is a plan view of FIG. 4D.

Though the above embodiment is constituted to adhere by fitting the adhering portion 10*b* between the members 10*a*, it is not limited to the above, but may be appropriately adhered by a well-known method of adhering. For example, it may be adhered by welding, as shown in FIGS. 4D and 4E. In addition, as shown in FIG. 4D, when the end portion of the members 10*a*, 10*a* is formed like a taper and a weld groove 10*h* having a shape of Letter 'V' is formed at the adhesive portion 10*b*, It results in a small amount of projected portion of weld bead 10*g*.

Though the above embodiments are constituted to form the adhesive portion 10*b* between the members 10*a*, 10*a* composing of the side constituent member 10 on a plane crossing to the rolling direction A, it may be adhered on a plane parallel to the rolling direction, in a case where the adhesion between the members 10*a*, 10*a* is strongly performed and there has no cracks or sieve openings at the time of rolling.

In a case where the adhesion between the members 10*a*, 10*a* is strongly performed and there has no fears that cracks or sieve openings occur at the time of rolling, the adhesive portion 10*b* of the members 10*a*, 10*a* may be arranged at the center in a direction of the width on a plane crossing to a rolling direction A.

Though the above embodiments are constituted to be approximately the same shape between the upper lid constituent member 11 and the lower lid constituent member 12, shapes, sizes, or the like of the upper lid constituent member 11 and the lower lid constituent member 12 are not particularly limited.

What is claimed is:

1. A case for rolling powder alloy formed in a shape of a box, the case comprising:

a side constituent member formed like a rectangular frame in a combination of a plurality of members and surrounding a side surface of metal powder;

an upper lid constituent member mounting on one opening of the side constituent member and covering an upper surface of the metal powder; and a lower lid constituent member mounting on the other opening of the side constituent member and covering a lower surface of the metal powder, wherein an outer peripheral surface of the side constituent member comprises a projected portion placed in a center in a direction of the height thereof along a peripheral direction, at least one peripheral edge of the upper lid constituent member and the lower lid constituent member is provided with a peripheral wall standing upright along an outer peripheral surface of the side constituent member, and the projected portion of the side constituent member is inserted into a space surrounded by the peripheral wall.

2. The case for rolling powder alloy according to claim 1, wherein the peripheral edges of the upper lid constituent member and the lower lid constituent member are respectively provided with the peripheral wall standing upright along the outer peripheral surface of the side constituent member, and an upper portion over the projected portion of the side constituent member is inserted into a space surrounded by the peripheral wall formed in the peripheral edge of the upper lid constituent member, and a lower portion below the projected portion of the side constituent member is inserted into a space surrounded by the peripheral edge formed in the peripheral edge of the lower lid constituent member.

3. The case for rolling powder alloy according to claim 2, wherein the projected portion is provided with an auxiliary slip formed integrally with a top portion and has a 'T' shaped cross section, and an outer peripheral surface of the peripheral wall is surrounded by the auxiliary slip.

* * * * *